US005934194A

United States Patent [19]

Puschnerat et al.

[11] Patent Number: 5,934,194

[45] Date of Patent: Aug. 10, 1999

[54] RUBBER BLANKET FOR A PRINTING MACHINE

[75] Inventors: Helmut Puschnerat, Wachenheim; Wolfgang Günter Ruckmann, Würzburg, both of Germany

[73] Assignee: Koenig & Bauer-Albert Aktiengesellschaft, Wurzburg, Germany

[21] Appl. No.: 09/068,972

[22] PCT Filed: Nov. 16, 1996

[86] PCT No.: PCT/DE96/02185

§ 371 Date: May 22, 1998

§ 102(e) Date: May 22, 1998

[87] PCT Pub. No.: WO97/18954

PCT Pub. Date: May 29, 1997

[30] Foreign Application Priority Data

Nov. 23, 1995 [DE] Germany ..... 195 43 584

[51] Int. Cl.[6] ..... B41F 27/12

[52] U.S. Cl. ..... 101/375; 428/909; 101/415.1

[58] Field of Search ..... 428/909; 101/415.1, 101/375, 376

[56] References Cited

U.S. PATENT DOCUMENTS

| | | | |
|---|---|---|---|
| 2,525,003 | 10/1950 | Smith | 101/475 |
| 4,643,093 | 2/1987 | Goar et al. | 101/415.1 |
| 5,103,729 | 4/1992 | Philpot | 101/415.1 |
| 5,188,031 | 2/1993 | Depa et al. | 101/415.1 |
| 5,357,863 | 10/1994 | McLean et al. | 101/415.1 |
| 5,669,306 | 9/1997 | Puschnerat | 101/415.1 |
| 5,687,648 | 11/1997 | Puschnerat | 101/415.1 |
| 5,749,298 | 5/1998 | Castelli et al. | 101/415.1 |

FOREIGN PATENT DOCUMENTS

| | | |
|---|---|---|
| 0246012 | 11/1987 | European Pat. Off. . |
| 0748688 | 6/1996 | European Pat. Off. . |
| 4320464 | 12/1994 | Germany . |
| 29507523 | 8/1995 | Germany . |

*Primary Examiner*—Edgar Burr
*Assistant Examiner*—Leslie Grohusky
*Attorney, Agent, or Firm*—Jones, Tullar & Cooper, P.C.

[57] ABSTRACT

A multi-layer rubber blanket, that is intended for use on a rubber blanket cylinder, is secured at its underside to a dimensionally stable support plate. The ends of the multi-layer rubber blanket are not affected by mechanical or chemical cleaning. This is accomplished by sealing the front or end faces of the layers of the multi-layer blanket, which are situated underneath the outer, cover layer of the rubber blanket.

12 Claims, 2 Drawing Sheets

RUBBER BLANKET FOR A PRINTING MACHINE

FIELD OF THE INVENTION

The present invention relates to a rubber blanket for a printing press The rubber blanket is a multi-layer blanket which is connected on its inner surface with a dimensionally stable support plate. At least one end of the support plate projects past an open end face of the multi-layer rubber blanket.

DESCRIPTION OF THE PRIOR ART

From DE 43 20 464 A1 it is known to insert beveled leading and trailing edges of a rubber blanket placed on a support plate together into a slit located on the surface of a cylinder. In this case, a space, which narrows in the direction of the slit, results between the bending lines. In order to prevent oscillations, this space is filled in a form-fitting manner.

A rubber blanket unit, consisting of a rubber blanket and a support plate, is described in U.S. Pat. No. 2,525,003. The rubber blanket unit is provided with two beveled edges, on each of which a beveled leg of the support plate is arranged to project past the ends of the rubber blanket. The rubber blanket on the support plate ends in the area of a bevel, which delimits the legs. These beveled legs are inserted into a narrow slit of approximately 6.5 mm width. A wedge is arranged between opposite lateral surfaces of the two legs. One leg is pressed against a lateral surface of the slit by this wedge. The rubber blanket unit is frictionally held in the slit in this way by means of a holding device embodied as a wedge.

In connection with this prior art rubber blanket unit it is disadvantageous that in the course of cleaning the rubber blanket cylinder, for example by means of a rotating brush, washing liquid enters between the two ends of the rubber blanket of the rubber blanket unit. Together with the rotation of the brush, a premature separation of at least one end of the rubber blanket is caused.

DE 29507523 U1 shows a rubber blanket unit consisting of a support plate and a multi-layer rubber blanket.

SUMMARY OF THE INVENTION

It is the object of the present invention to create a multi-layer rubber blanket with a dimensionally stable support plate.

This object is attained in accordance with the present invention by providing a rubber blanket unit for a rubber blanket cylinder of a printing press. The rubber blanket is a multi-layer that is secured to a dimensionally stable support plate. At least one end of the support plate projects past an open end face of the multi-layer rubber blanket.

The advantages to be obtained by means of the present invention consist, in particular, in that no separation from the rubber blanket support, or respectively the further rubber blanket layers, at the leading end of the rubber blanket occurs, even in the course of intensive mechanical and chemical cleaning. For the purpose of retaining the rubber blanket on the rubber blanket cylinder, it is only necessary to put the ends of the support into a slit. Because of this, the space without print becomes very small.

It furthermore is advantageous that a bristle roller cannot extend under the cover layer of the rubber blanket. In addition, no dampening or washing liquid can enter from the front face of the rubber blanket.

BRIEF DESCRIPTION OF THE DRAWINGS

The device in accordance with the present invention is represented in the drawings and will be described in more detail in what follows.

Shown are in.

DESCRIPTION OF THE PREFERRED EMBODIMENTS

Figure 1:
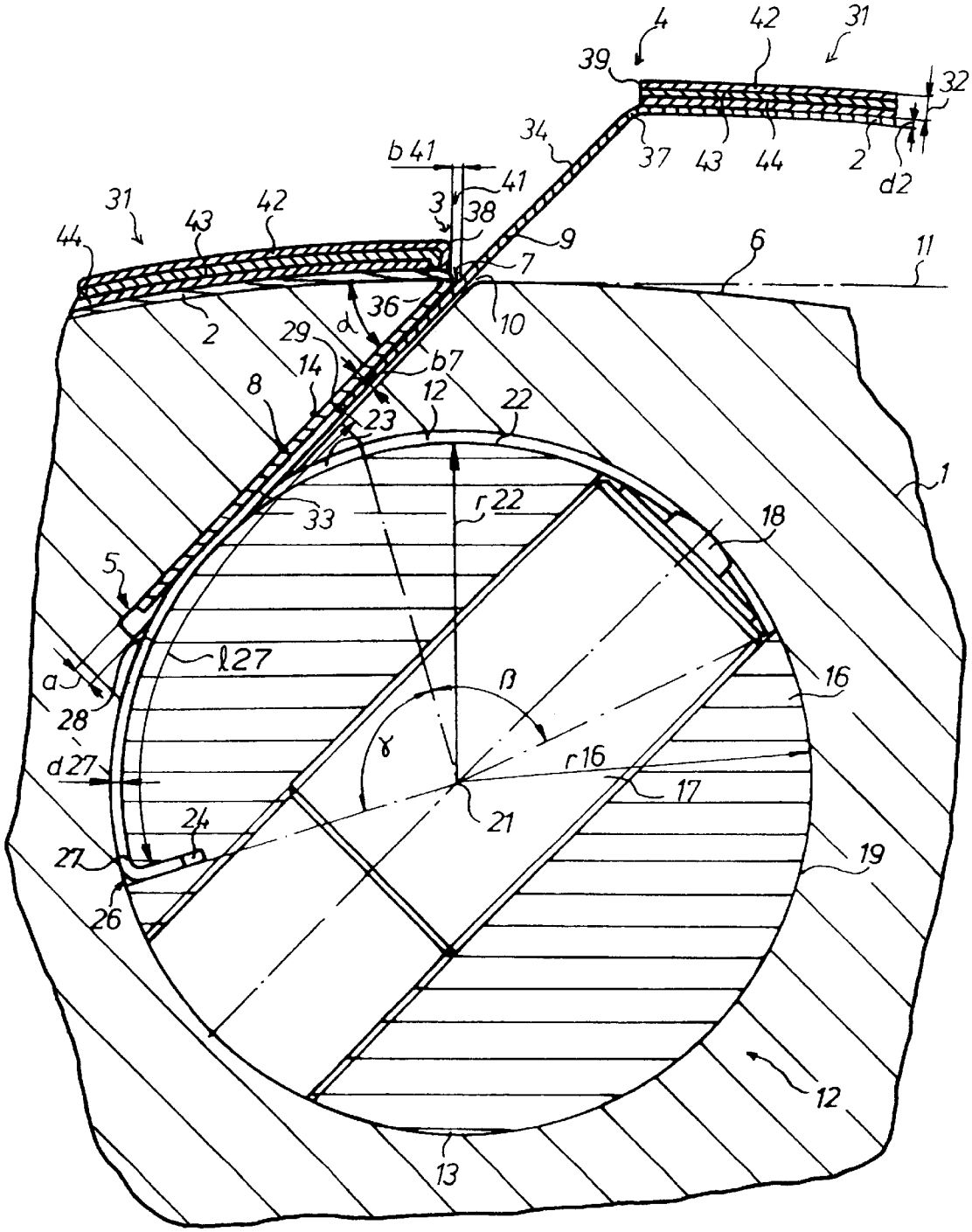
FIG. 1, a schematic representation of a cross section of a rubber blanket in accordance with the invention on a rubber blanket support, whose one beveled edge is lifted out of a slit of the rubber blanket support.

For receiving rubber blanket units 31 with beveled leading and trailing ends 3, 4, a rubber blanket cylinder 1 of a rotary printing press is provided with at least one narrow slit 7, which extends parallel to the axis of rotation of cylinder 1 and extends from a jacket surface 6 of the rubber blanket cylinder 1 into its interior 5, all as seen in FIG. 1.

The rubber blanket unit 31 consists of a generally dimensionally stable, flexible blanket support plate 2, for example a metal plate, of a thickness d2, for example d2=0.3 mm, and a multi-layer rubber blanket 32 fastened on an upper surface of support plate 2, for example by gluing or vulcanization.

Figure 2:
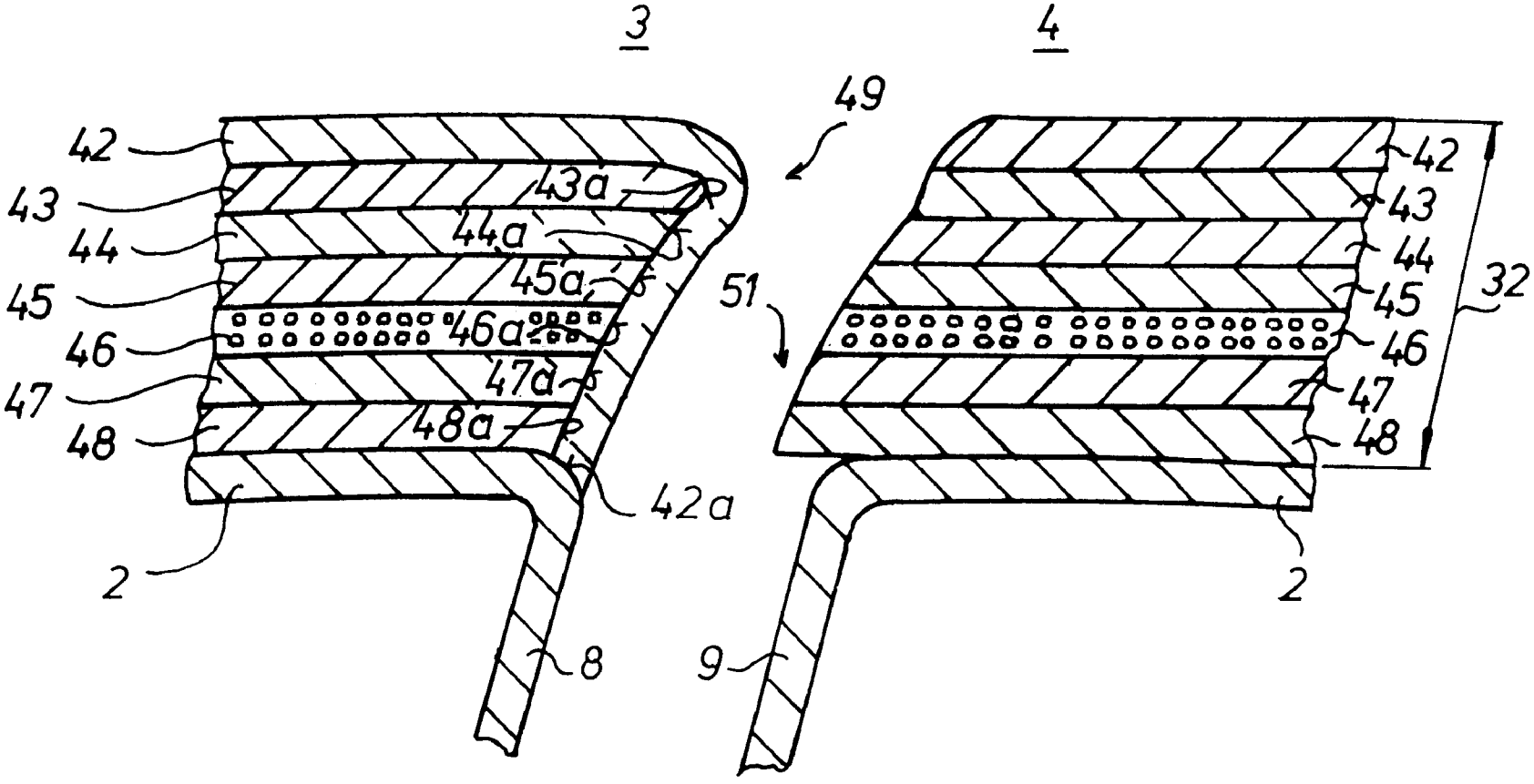
FIG. 2, a section through an enlarged schematic representation of both ends of the rubber blanket in accordance with the present invention applied to the rubber blanket support in a second embodiment.

In the present device, a beveled or angled leg 8 at the leading end 3 is longer than a corresponding beveled leg 9 on the trailing end 4 of the support plate. The multi-layer rubber blanket 32 consists of several layers in the form of a composite, for example a cover layer 42, a woven layer 43, an adhesive layer 44, a first or outer reinforcement layer 45, a compressible layer 46 with closed hollow spaces, a second or intermediate reinforcement layer 47 and a third or inner reinforcement layer 48, which is connected with the support plate 2, all as seen in FIG. 2. These layers 42 to 48 are connected with each other, for example by gluing or vulcanization, in a form-fitting manner.

At least an end of the cover layer 42 of the rubber blanket 32 projects past the layers 43 to 48 underneath it and is folded around them. An underside of this end of the cover layer 42 rests against front or end faces 43*a* to 48*a* of the remaining rubber blanket layers 43 to 48 and is fastened to them in a form-fitting manner, for example by gluing or vulcanization as is depicted most clearly in FIG. 2.

Sealing of the front or end faces 43*a* to 48*a* of at least one end, in particular of the leading end 3, of the rubber blanket 32 is provided in this way. It is also possible to seal the second or trailing end 4 of the rubber blanket 32 in this way.

In accordance with another preferred embodiment it is additionally possible for the leading end or front face 42*a* of the cover layer 42 to be connected in a form-fitting manner with the support plate 2. This is shown in FIG. 2.

In accordance with a further preferred embodiment it is also possible that sealing takes place in that the cover layer 42 of the rubber blanket is bent over and only the front face or end 42*a* of the cover layer 42 is form-fittingly connected with the support plate 2.

The front faces or ends 43*a* to 48*a* which are covered by the cover layer 42, and the layers 43 to 48 of the multi-layer rubber blanket underneath it can be embodied as an overhanging projection 49, extending in the axis-parallel direction of the rubber blanket cylinder 1 at the level of the layers 43, 44 of the leading end 3 of the rubber blanket 32. This projection 49 works together with a slope 51, which is itself located on the trailing end 4 of the rubber blanket 32, at the level of the layers 44 to 48, and also extending in an axis-parallel direction. The projection 49 is formed in that the layers 43 to 48 become shorter in steps towards the support plate 2. The slope 51 is formed since the layers 48 to 44 become shorter in steps from the support plate 2 toward the exterior of the blanket 32. When clamping the rubber blanket unit 31 to the rubber blanket cylinder 1, a very narrow gap of the rubber blanket 32 is achieved in this way, which is sealed at its front faces.

It is also possible to make a further, underlying layer 43, besides the cover layer 42, longer, and to conduct or fold the ends of both of these layers 42, 43 over the front faces 44*a* to 48*a* of the layers underneath them and to fasten them in the above described manner.

The rubber blanket 32 is fastened on the support plate 2 in such a way that the two beveled legs 8, 9 of the support plate 2 are free of the rubber blanket 32 at the beveled ends 3, 4 of the rubber blanket unit 31, so that only the two legs 8, 9 of the support plate 2 project into the slit 7.

The slit 7 is preferably embodied to be rectangular in cross section. At its start 10, a width b7 of the cross section of the slit 7 has slightly more than double the thickness d2 of the support plate 2 of the rubber blanket unit 31, i.e. b7=1 mm for example. In relation to a tangent 11 placed against the jacket surface 6 of the blanket cylinder 1 in the area of the slit 7, the slit 7 is inclined by an angle of inclination α alpha, for example alpha=45°. A bore 12 extending parallel with the slit 7 is disposed in the rubber blanket cylinder 1 at the radially inner end ofthe slit 7. The slit 7 is tangent to the bore 12 in the shape of a chord, so that the bore 12 is connected with the slit 7. In the present configuration, a virtual extension of a jacket surface 13 of the bore 12 is at a distance "a" from a lateral surface 14 of the slit 7 facing away from the bore 12, wherein the distance "a" is slightly greater than the thickness d2 of the support plate 2, for example a=0.4 mm.

A pivot lever or spindle 16, in this case embodied as a spindle 16 with a radius r16, for example r16-15mm, is seated centered and pivotably in this bore 12. This spindle 16 has been provided in the axial direction with several thrust pads 17, which act radially toward the exterior of spindle 16 and which are each provided with radially outwardly acting pressure cams 18. The thrust pads 17 have been fastened in the spindle 16 in such a way, that their pressure cams 18 can resiliently act past a jacket surface 19 of the spindle 16. In the configuration represented in FIG. 1, the pressure cams 18 are each provided with a spherical dome at their outer ends, but embodiments of these cams 18 in the form of a segment of a cylinder are also possible, so that a linearly-shaped contact zone results for each pressure cam 18. Starting in the area of the spindle 16 in which the thrust pads 17 are arranged, the jacket surface 19 of the spindle 16 has a first jacket surface 22 of a reduced radius r22, for example r22=14.5 mm, β over an angle beta, for example beta=80°, in relation to a longitudinal axis 21 of the spindle 16. In the depicted configuration shown in FIG. 1 an area adjoins this, which extends over an angle gamma, γ for example gamma=90°, in which, viewed in the axial direction, a second reduced jacket surface 22 is provided in the form of U-shaped grooves 23 extending in the circumferential direction. An axially extending slit 24 has been cut at the end of these U-shaped grooves 23, which axially extending slit 24 extends radially from the jacket surface 19 into an interior of the spindle 16. First or secured ends 26 of flexurally elastic, but pressure-resistant lifters 27 have been suspended in this slit 24. These lifters 27 are embodied as leaf springs. In the installed state, these lifters 27 are adapted to the shape of the spindle 16. The lifters 27 extend over a length l27, for example l27=25 mm, in the area of the U-shaped grooves 23 of the spindle 16 to lifter free ends faces 28, and each have a thickness d27, for example d27=0.5 mm.

The mode of functioning of the device in accordance with the invention is as follows:

In an insertion position of the spindle 16, the reduced jacket surface 22 of the spindle 16 is located in the area ofthe slit 7. In this insertion position, the two beveled legs 8, 9 of the ends 3, 4 of support plate 2 of the rubber blanket unit 31 are guided into the slit 7, wherein the reduced jacket surface 22 is used as a guide. The beveled ends 3, 4 of the rubber blanket unit 31 are matched to the angle of inclination alpha of the slit 7. With the rubber blanket unit 31 inserted, the legs 8, 9 of the support plate 2 of the rubber blanket unit 31, which have no rubber blanket 32, rest directly against each other with their facing lateral outer surfaces 33, 34 in face to face contact. Both at the leading end 3 and at the trailing end 4, the rubber blanket 32 extends as far as to the slit 7 interrupting the jacket surface 6 of the rubber blanket cylinder 1, i.e. the rubber blanket 32 ends on the support plate 2 respectively in the area of a bevel 36, 37 of the legs 8, 9. Therefore opposite ends 38, 39 of the rubber blanket 32 form a narrow gap 41 of a width b41, for example b41=0.3 mm, all as shown in FIG. 1. In the first preferred embodiment shown in FIG. 1, the rubber blanket 32 has been slightly pulled around the bevel 36 at the leading end 3, but without resting against the leg 9 of the support plate 2 of the trailing end 4.

To clamp the ends 3, 4 of the rubber blanket unit 31, the spindle 16 is turned counterclockwise until the thrust pads 17 extend approximately oriented perpendicularly in relation to the legs 8, 9 of the support plate 2. The pressure cams 18 ofthe thrust pads 17 are pressed against the legs 8, 9 of the support plate 2 by means of spring force supported on the spindle 16. In this way, the legs 8, 9 of the support plate 2 are clamped in the slit 7 of the rubber blanket cylinder 1 between the lateral surface 14 of the slit 7 and the pressure cams 18, so that the ends 3, 4 of the rubber blanket cylinder unit 31 are securely fastened on the rubber blanket cylinder 1. The spring force and the spring travel are calculated such that secure clamping takes place. By rotating the spindle 16 counterclockwise, i.e. with the effective pressure cams 18 being turned in the direction of the interior of the rubber blanket cylinder 1, tightening of the ends 3, 4 occurs by means of the inwardly acting tension force. The spindle 16 can then be locked in place in this clamping position.

For removing the rubber blanket unit 31, the spindle 16 is turned clockwise, whereupon the thrust pads 17 release the legs 8, 9. The thrust pads 17 are conducted into the bore 12, in which the thrust pads 17 are supported on the surface 13 of the bore 12. Because of the rotating movement of the spindle 16, ends 28 of the lifters 27 now come into the area of the end of the leg 9 of the trailing end 4 of the rubber blanket unit 31 and push against a front face 29 of the leg 9 of the trailing end 4. In the course of the continued rotating movement of the spindle 16, the lifters 27 resiliently spring outward into their extended position, so that the lifters 27 extend tangentially in relation to the spindle 16 and extend into the slit 7. The spindle 16 is rotated until the ends 28 of the lifters 27 are closely underneath the jacket surface 6 of the rubber blanket cylinder 1. The trailing end 4 of the rubber blanket unit 31 has been completely removed out of the slit 7 by means of the lifters 27 and can spring back away from the jacket surface 6 of the rubber blanket cylinder 1 because of the inherent tension of the rubber blanket unit 31.

In place of the thrust pads 17, which are provided with a compression spring acting on the pressure cams 18, it is also possible, for example, to arrange pre-stressed leaf springs, arranged in the circumferential direction, which project past the jacket surface 19 of the spindle 16.

While preferred embodiments of a rubber blanket for a printing press in accordance with the present invention have been set forth fully and completely hereinabove, it will be apparent to one of skill in the art that a number of changes in, for example, the overall size of the cylinder, the type of printing being done by the printing press, the drive for the press and the like could be made without departing from the true spirit and scope of the present invention which is accordingly to be limited only by the following claims:

What is claimed is:

1. A rubber blanket unit useable with a rubber blanket cylinder of a printing press, said rubber blanket unit comprising:

a multi-layer having a first end rubber blanket including at least a cover layer and an inner layer having a first end having an end face;

a dimensionally stable support plate having at least one end, said inner layer having a first end of said multi-layer rubber blanket being secured to said support plate, said at least one end of said support plate projecting past said end face of said inner layer; and a cover layer having a first end extending over, and sealing said end face of said inner layer having a first end of said multi-layer rubber blanket.

2. The rubber blanket of claim 1 wherein said at least one end of said support plate is beveled.

3. The rubber blanket unit of claim 1 wherein said multi-layer rubber blanket forms an overhanging projection with said at least one end of said support plate.

4. The rubber blanket unit of claim 1 further including a second end of said support plate.

5. The rubber blanket unit of claim 4 wherein said cover layer and said inner layer each have a second end, and further wherein said cover layer second end and said inner layer second end overlie said support plate second end.

6. The rubber blanket unit of claim 5 further wherein said cover layer second end and said inner layer second end form a slope.

7. The rubber blanket unit of claim 1 wherein said end of said cover layer is bent over and secured on said end face of said inner layer of said multi-layer rubber blanket.

8. The rubber blanket unit of claim 7 further wherein said end of said cover layer has an end face, said end face of said cover layer being secured to said end of said support plate.

9. The rubber blanket unit of claim 1 further including at least one intermediate layer intermediate said cover layer and said inner layer, said at least one intermediate layer having an end face sealed by said cover layer end.

10. The rubber blanket unit of claim 9 including a plurality of said intermediate layers.

11. A rubber blanket unit useable with a rubber blanket cylinder of a printing press, said rubber blanket unit comprising:

a multi-layer rubber blanket including a cover layer and at least one inner layer having an underside and an end face;

a dimensionally stable support plate having at least one end, said underside of said inner layer of said multi-layer rubber blanket being secured to said support plate, said at least one end of said support plate projecting past said end face of said at least one inner layer; and means sealing said end face of said at least one inner layer of said multi-layer rubber blanket said means including a cover layer end, said cover layer end being bent over and secured on said end face of said at least one inner layer of said multi-layer blanket.

12. The rubber blanket unit of claim 11 further wherein said cover layer end has an end face, said cover layer end face being secured to said end of said support plate.

* * * * *